United States Patent [19]

Hasegawa et al.

[11] Patent Number: 4,502,443

[45] Date of Patent: Mar. 5, 1985

[54] AIR/FUEL RATIO CONTROL METHOD HAVING FAIL-SAFE FUNCTION FOR ABNORMALITIES IN OXYGEN CONCENTRATION DETECTING MEANS FOR INTERNAL COMBUSTION ENGINES

[75] Inventors: Shumpei Hasegawa, Niiza; Akihiro Yamato, Shiki, both of Japan

[73] Assignee: Honda Giken Kogyo Kabushiki Kaisha, Tokyo, Japan

[21] Appl. No.: 498,951

[22] Filed: May 27, 1983

[30] Foreign Application Priority Data

May 28, 1982 [JP] Japan ..... 57-90659

[51] Int. Cl.[3] ..... F02M 7/00

[52] U.S. Cl. ..... 123/440; 123/489; 123/479

[58] Field of Search ..... 123/440, 489, 479

[56] References Cited

U.S. PATENT DOCUMENTS

| | | | |
|---|---|---|---|
| 3,938,479 | 2/1976 | Oberstadt | 123/489 |
| 4,248,196 | 2/1981 | Toelle | 123/489 |
| 4,252,098 | 2/1981 | Tomczak et al. | 123/489 |
| 4,359,029 | 11/1982 | Furuhashi et al. | 123/489 |
| 4,392,471 | 7/1983 | Miyagi et al. | 123/489 |
| 4,399,792 | 8/1983 | Otsuka et al. | 123/489 |
| 4,414,950 | 11/1983 | Otsuka et al. | 123/479 |

FOREIGN PATENT DOCUMENTS 210137 of 0000 Japan .

*Primary Examiner*—Parshotam S. Lall
*Attorney, Agent, or Firm*—Lyon & Lyon

[57] ABSTRACT

An air/fuel ratio control method in which the air fuel ratio of an air/fuel mixture being supplied to an internal combustion engine, is controlled to required values in synchronism with generation of a predetermined control signal, by the use of a first coefficient which has a value variable with a change in the output of the oxygen concentration detecting means, during feedback mode control, and by the use of a second coefficient which is a mean value of values of the first coefficient applied during the above feedback mode control, during operation of the engine in a mode other than the feedback mode control. When an abnormality occurs in the functioning of the oxygen concentration detecting means, the second coefficient alone is always used for the air/fuel ratio control. Preferably, it is determined that an abnormality occurs in the oxygen concentration detecting means, either if a difference between a value of the first coefficient obtained at generation of a present pulse of the above control signal and a value of the same coefficient obtained at generation of a preceding pulse of the same control signal does not change from a negative value to a positive value or vice versa for a predetermined period of time, or if the output value of the oxygen concentration detecting means does not change across a predetermined reference value at all for a second predetermined period of time after the engine temperature has exceeded a predetermined value at or after the start of the engine.

5 Claims, 10 Drawing Figures

| FIG. 1A | FIG. 1B |
|---|---|

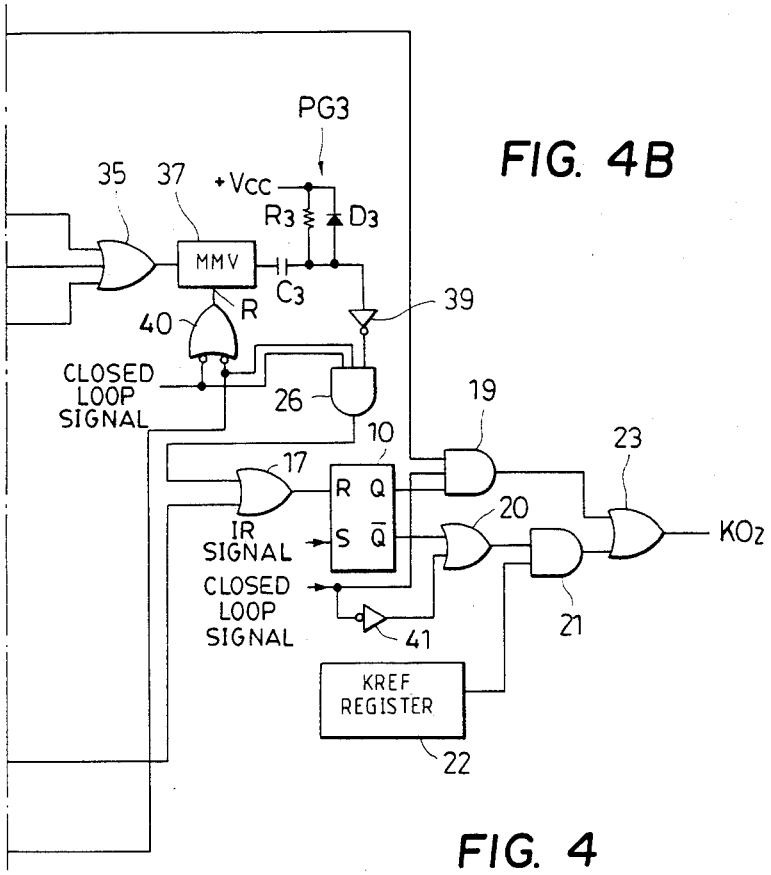
FIG. 4B
FIG. 4
| FIG. 4A | FIG. 4B |
|---|---|
FIG. 5
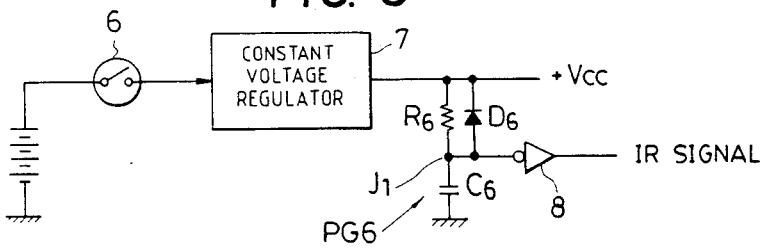

AIR/FUEL RATIO CONTROL METHOD HAVING FAIL-SAFE FUNCTION FOR ABNORMALITIES IN OXYGEN CONCENTRATION DETECTING MEANS FOR INTERNAL COMBUSTION ENGINES

BACKGROUND OF THE INVENTION

This invention relates to an air/fuel ratio control method for feedback control of the air/fuel ratio of an air/fuel mixture being supplied to an internal combustion engine in response to oxygen concentration in the exhaust gases emitted from the engine, and more particularly to a method of this kind which enables the engine to positively continue its operation even when an abnormality occurs in the oxygen concentration detecting means.

A fuel supply control system adapted for use with an internal combustion engine, particularly a gasoline engine has been proposed e.g. by U.S. Pat. No. 3,483,851, which is adapted to determine the valve opening period of a fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concetration (oxygen concentration), etc., by electronic computing means.

According to this proposed fuel supply control system, the air/fuel ratio control is effected such that when the engine is in normal operating condition, the valve opening period of the fuel quantity metering or adjusting means is controlled in closed loop mode, whereas when the engine is in any of predetermined particular operating conditions other than the normal operating condition, such as an idling region, a mixture leaning region, a wide-open-throttle region, and a decelerating region, the valve opening period is controlled in open loop mode wherein a corresponding one of predetermined coefficients having predetermined values appropriate to respective such particular operating conditions is applied, so as to achieve a desired air/fuel ratio appropriate to such particular operating condition, thereby improving the fuel consumption and driveability of the engine.

It is thus desirable that a predetermined air/fuel ratio corresponding to each of the particular operating conditions can be achieved with certainty by means of open-loop control. However, as a matter of fact, the actual air/fuel ratio can sometimes have a value different from a desired predetermined value due to variations in the performance of various sensors for detecting the operating condition of the engine and a system for controlling or driving the fuel quantity metering or adjusting means. In such event, it is impossible to obtain required operational stability and driveability of the engine.

To overcome such disadvantage, there has been proposed by the assignee of the present application in U.S. Pat. No. 4,445,482 a fuel supply control method which is improved over the aforementioned proposed fuel supply control system, and in which a mean value of values of a first coefficient applied during feedback mode control of the air/fuel ratio effected in response to detected values of the oxygen concentration in the engine exhaust gases is calculated and stored as a second coefficient, and the second coefficient is used for control of the air/fuel ratio in open loop mode, thereby achieving air/fuel ratios closer to predetermined or required air/fuel ratios corresponding to the respective particular operating conditions.

However, even with such improved method, when an abnormality occurs in the functioning of the oxygen concentration detecting means, such as a disconnection in the wiring, a proper air/fuel ratio cannot be achieved, resulting in an abnormal air/fuel ratio of the mixture being supplied to the engine, if no countermeasure is taken to cope with such abnormality.

SUMMARY OF THE INVENTION

It is the object of the invention to provide an air/fuel ratio control method for an internal combustion engine, which enables positive continuation of the operation of the engine without causing stoppage of the engine, when an abnormality occurs in the functioning of the oxygen conctration detecting means.

The present invention provides a method which controls the air/fuel ratio of an air/fuel mixture being supplied to an internal combustion engine having oxygen concentration detecting means for detecting oxygen concentration in exhaust gases emitted from the engine, in synchronism with generation of pulses of a predetermined control signal, by applying at least one coefficient such as those specified below to such air/fuel ratio control in the following manner:

(1) a first coefficient having a value variable with a change in the output of the oxygen concentration detecting means, when the engine is operating in a feedback mode control region wherein the air/fuel ratio is controlled in response to the output of the oxygen concentration detecting means;

(2) a second coefficient which has a mean value of values of the first coefficient applied during operation of the engine in the above feedback mode control region, when the engine is operating in any of a plurality of predetermined particular operating regions other than the feedback mode control region; and (3) the above second coefficient when an abnormality is detected in the oxygen concentration detecting means whether the engine is operating in the feedback mode control region or in any of the predetermined particular operating regions.

Preferably, it is determined that an abnormality occurs in the oxygen concentration detecting means when either one of the following conditions is fulfilled:

(a) a difference between a value of the first coefficient obtained at generation of a present pulse of the aforementioned control signal and a value of the same coefficient obtained at generation of a preceding pulse of the same control signal does not change from a negative value to a positive value or vice versa for a predetermined period of time;

(b) when the engine temperature is higher than a predetermined value at the start of the engine, the output voltage value from the oxygen concentration detecting means does not change across a predetermined reference voltage value at all for a second predetermined period of time after the start of the engine; and (c) when the engine temperature is not higher than the above predetermined value at the start of the engine, the output voltage value from the oxygen concentration detecting means does not change across the above predetermined reference voltage value at all for the above second predetermined period of time after the engine temperature has exceeded the above predetermined value after the start of the engine.

More preferably, detection of the occurrence of an abnormality in the oxygen concentration detecting means is prohibited when the engine rotational speed is lower than a predetermined value, thereby preventing a wrong diagnosis that an abnormality occurs in the oxygen concentration detecting means, for instance, upon fulfillment of either one of the aforementioned conditions (a)–(c) in the event that once the engine is started, the engine again stops without switching the ignition switch off after the start of the engine.

The above and other objects, features and advantages of the invention will be more apparent from the ensuing detailed description taken in conjunction with the accompanying drawings:

BRIEF DESCRIPTION OF THE DRAWINGS

FIGS. 4A and 4B are a circuit diagram showing, by way of example, a circuit for determining the occurrence of an abnormality in the output signal of the $O_2$ sensor and, when there occurs an abnormality in the output signal, generating a KREF value as a value of a second coefficient, in place of the $KO_2$ value being the first coefficient;

FIG. 5 is a circuit diagram showing, by way of example, a circuit for generating a single pulse signal IR when the ignition switch is closed.

DETAILED DESCRIPTION

The fuel supply control method according to the invention will now be described in detail with reference to the drawings.

Figures 1, 1B:
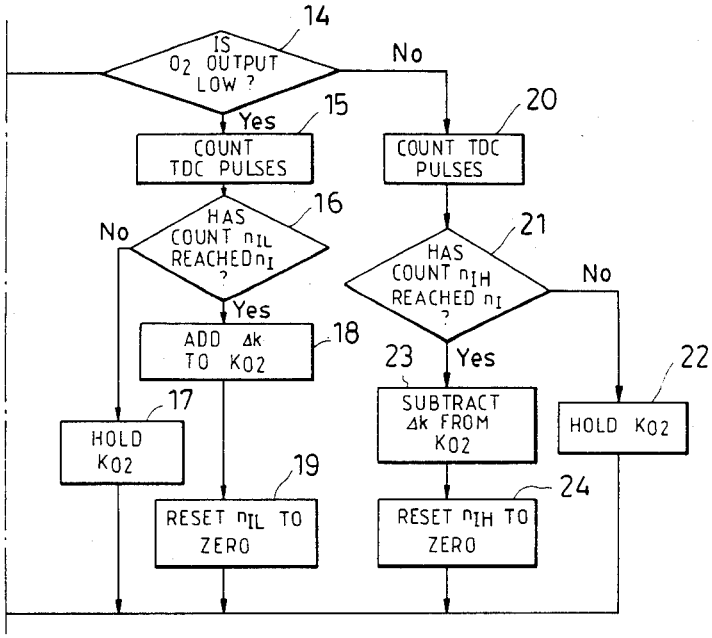
FIGS. 1A and 1B are a flow chart showing a manner of calculating a feedback mode control coefficient $KO_2$ as well as a manner of determining the occurrence of an abnormality in the $O_2$ sensor, according to the present invention.
Figure 1A:
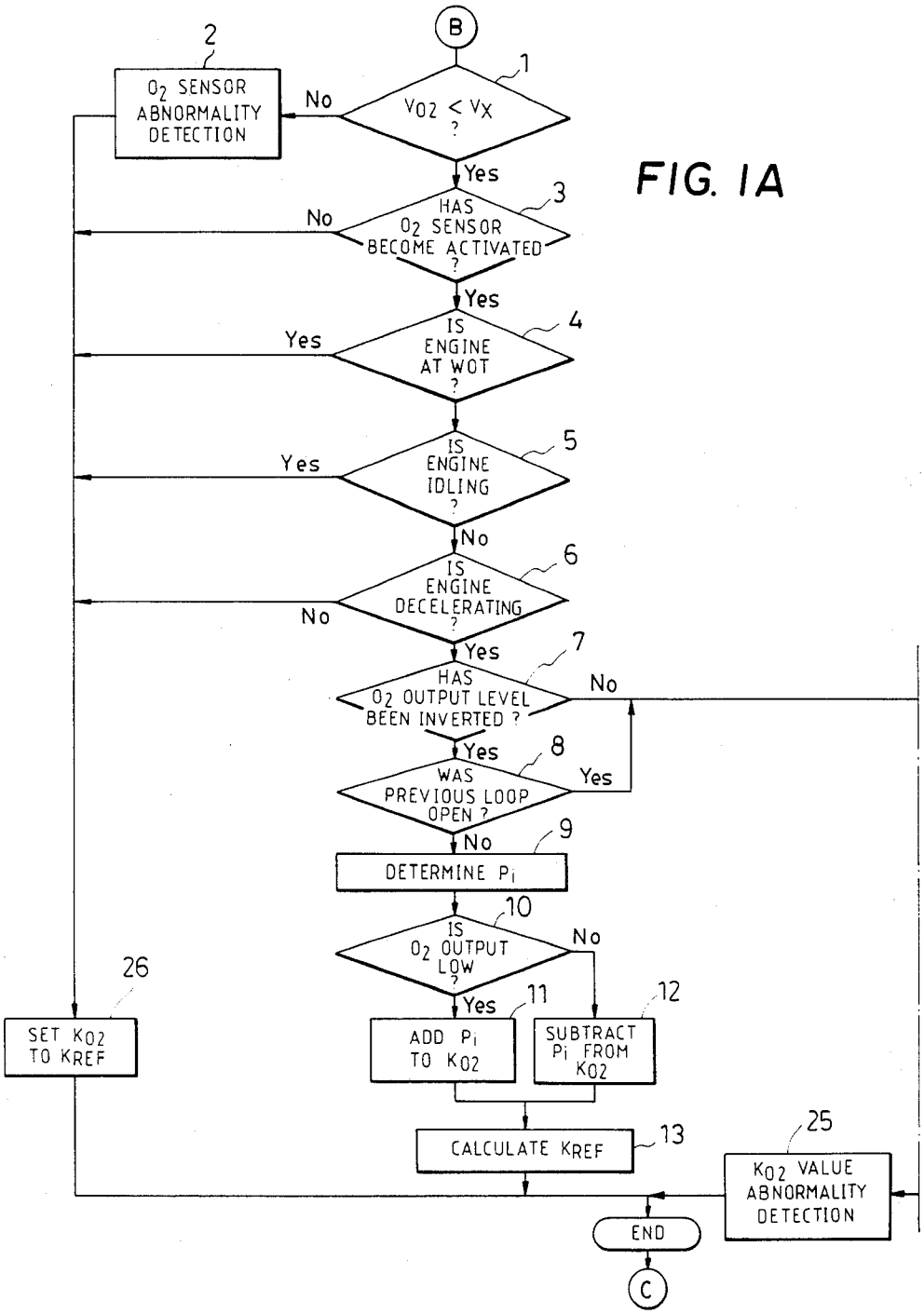
Figure 2:
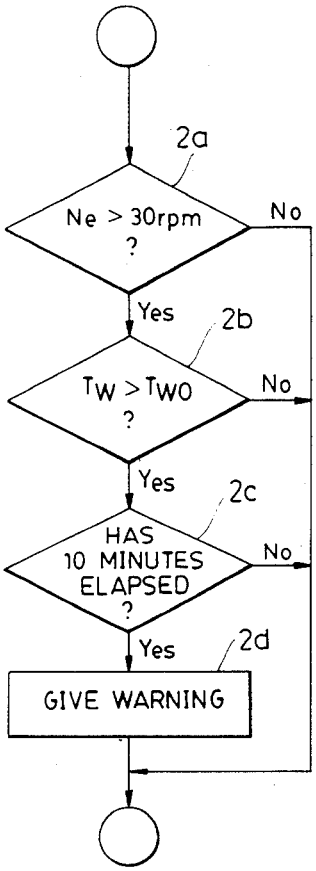
FIG. 2 is a flow chart showing details of the manner of determining the occurrence of an abnormality in the $O_2$ sensor of the step 2 of FIG. 1.
Figure 3:
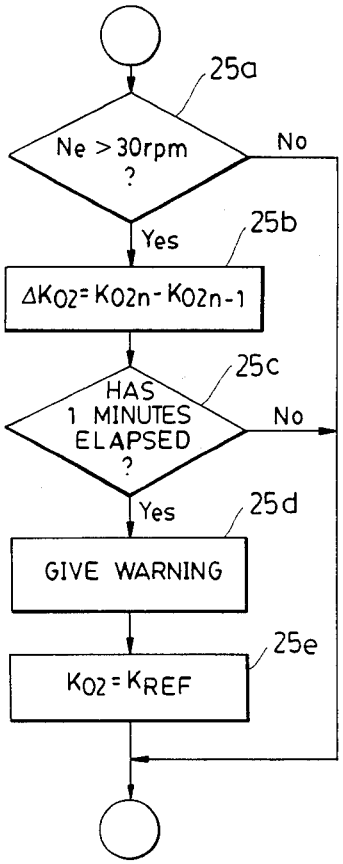
FIG. 3 is a flow chart showing details of a manner of determining the abnormality of the $KO_2$ value of the step 25 of the flow chart of FIG. 1.

Referring first to FIGS. 1 through 3, there are illustrated flow charts for calculating the values of a first coefficient (hereinafter merely called "the $KO_2$ value" or "the value $KO_2$") which is dependent upon the output of an oxygen concentration detecting means (hereinafter merely called "the $O_2$ sensor") and a second coefficient (hereinafter called "the KREF value" or "the value KREF") the value of which is a mean value of values of the first coefficient, as well as for determining the occurrence of an abnormality in the functioning of the oxygen concentration detecting means. The $O_2$ sensor applicable to the invention is formed of stabilized zirconium oxide or the like, and is inserted in the exhaust pipe of the engine, for detection of oxygen concentration in exhaust gases emitted from the engine. The $O_2$ sensor generates an output voltage varying with a change in the oxygen cencentration.

According to the manner of detecting abnormality in the $O_2$ sensor shown in FIG. 1, it is first determined whether or not the $O_2$ sensor has been activated, at the steps 1 and 3, since determination of the occurrence of an abnormality in the $O_2$ sensor has to be carried out only after a predetermined period of time elapses after the start of the engine within which the activation of the $O_2$ sensor needs to be completed. There are many types of manner of determining the activation of such $O_2$ sensor. For instance, according to well known manners, it is determined that the $O_2$ sensor has been activated if it is detected that:

(1) the output voltage from the $O_2$ sensor has increased across a predetermined reference voltage when the air/fuel ratio of a mixture being supplied to the engine becomes richer than a theoretical ratio, that is, the fuel ratio becomes larger than that at the theoretical air/fuel ratio (Japanese Patent Provisional Publication No. 53-112331); or (2) the output voltage from the $O_2$ sensor has increased across a first predetermined reference voltage which is higher than a comparative level equivalent to a reference voltage applied for comparison with the sensor output voltage during feedback control or has dropped across a second predetermined reference voltage which is lower than the comparative level U.S. Pat. No. 4,208,993; or (3) the output voltage from the $O_2$ sensor through which a predetermined amount of electric current flows has dropped across a predetermined reference voltage when the air/fuel ratio of the mixture being supplied to the engine becomes leaner than the theoretical ratio, that is, fuel becomes lean (the so-called internal resistance detection method) U.S. Pat. No. 4,094,186.

Although any of the above-mentioned methods can be applied to the method of the invention, the following embodiment is based upon the application of the method (3), i.e. the internal resistance detection method to the method of the invention.

It is first determined at the step 1 in FIG. 1 whether or not the output voltage from the $O_2$ sensor has dropped to an activation initiating point Vx (e.g. 0.6 volt). If the determination shows that the output voltage is still higher than the activation initiating point Vx, the program proceeds to the step 2 where the occurrence of an abnormality in the $O_2$ sensor is detected.

FIG. 2 shows a first method for determining the adnormality of the $O_2$ sensor. First, whether or not the engine rpm Ne is larger than predetermined rpm, for instance, 30 rpm, is determined at the step 2*a* in FIG. 2. If the determination shows a negative result, that is, if the engine rpm is smaller than 30 rpm, the program proceeds to the step 26 in FIG. 26, without making a determination as to the abnormality of the $O_2$ sensor. Next, if the determination at the step 2*a* gives an affirmative answer, it is then determined at the step 2*b* whether or not the engine cooling water temperature TW is higher than a predetermined value TW0. If it is determined that the engine temperature is lower than the predetermined value TW0, that is, when the engine is in a cold state, the value of a fuel increasing coefficient KTW is set to a value dependent upon the engine cooling water temperature ($KTW \geqq 1.0$), thereby improving the driveability and emission characteristics of the engine by supplying a fuel quantity corresponding to a product of a basic fuel quantity by the value of the above coefficient KTW to the engine.

If the mixture supplied to the engine is too rich after the fuel increasing coefficient KTW has been set to a value larger than 1 when the engine water temperature TW is lower than the predetermined value TW0, the output voltage from the $O_2$ sensor can be higher than the reference voltage Vx. In such event, it is impossible to make a determination as to the abnormality of the $O_2$ sensor. Therefore, if the engine temperature is lower than the predetermined value TW0 (TW<TW0), the program proceeds to the step 26 in FIG. 1. If the relationship of TW>TW0 stands at the step 2*b*, the program proceeds to the step 2*c* where it is determined whether or not repeated execution of the step 2*c* has been continued for 10 minutes. If the answer is yes, warning is given of the occurrence of an abnormality in the $O_2$ sensor. That is, the $O_2$ sensor is diagnosed as being abnormal in function and a warning action is taken if the output voltage from the $O_2$ sensor 15 has continuously been above the reference voltage Vx over ten minutes after the engine temperature TW has become higher than the predetermined value TW0.

Since the fuel increasing coefficient KTW is set to 1.0 when the engine temperature TW is higher than the predetermined value TW0, the determination as to whether or not the engine temperature TW is higher than the predetermined value TW0 may be replaced by a determination as to whether or not the coefficient value KTW is equal to 1.0, at the step 2*b*. The above warning action may comprise actuating a warning device such as a warning lamp. Simultaneously with the warning action, the value of a fuel correction coefficient $K0_2$ is set to a mean value KREF obtained during feedback mode control responsive to the output of the $O_2$ sensor and thereafter held at the same mean value, as hereinafter described in detail. Incidentally, if the output voltage from the $O_2$ sensor drops below the reference voltage Vx even once after the start of the engine, the determination of the steps in FIG. 2 as to the abnormality of the $O_2$ sensor is not executed.

If the answer to the determination at the step 1 in FIG. 1 is yes, that is, if the output voltage of the $O_2$ sensor is below the reference voltage Vx, it is then determined whether or not the engine is in one of open loop mode control regions which are individually determined at the steps 3 to 6. For instance, at the step 3, it is determined by means of a delay timer whether or not a predetermined period of time (e.g. 60 seconds) has elapsed after the output voltage of the $O_2$ sensor has dropped below the reference voltage Vx, and it is also determined whether or not the engine water temperature TW is higher than the predetermined value TW0. If both of the two conditions are satisfied, the $O_2$ sensor is determined to be in an activated state. If the answer to the question at the step 3 is negative the value of the coefficient $KO_2$ is set to the above-mentioned mean value KREF, at the step 26. On the other hand, if the answer is affirmative, it is determined at the step 4 whether or not the engine is in a wide-open-throttle operating condition. If the answer is yes, the value of the coefficient $KO_2$ is set to the mean value KREF at the step 26, whereas if the answer is no, whether or not the engine is in an idling condition is determined at the step 5. If the engine rpm Ne is smaller than a predetermined value (e.g. 1,000 rpm) and at the same time, if the intake pipe absolute pressure PB is smaller than a predetermined value (e.g. 360 mmHg), the value of the coefficient $KO_2$ is set to the mean value KREF, at the step 26. When it is determined that the engine is in a condition other than in an idling condition, it is determined whether or not the engine is in a decelerating condition, at the step 6. That is, either when a fuel cut condition is fulfilled or when the intake pipe absolute pressure PB is lower than a predetermined value (e.g. 200 mmHg), the engine is judged to be in a decelerating condition, and then the value of the coefficient KO is set to the mean value KREF, at the step 26. On the other hand, when the engine is judged not to be in such decelerating condition, the program proceeds to the closed loop mode control.

In the closed loop control, it is first determined whether or not there has occurred an inversion in the output level of the $O_2$ sensor, at the step 7. If the answer is affirmative, whether or not the previous loop was an open loop is determined at the step 8. If it is determined that the previous loop was not an open loop, the air/fuel ratio of the mixture is controlled by proportional term control (P-term control).

The P-term control is effected in such a manner that the value of a correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value determined above is added to the coefficient $KO_2$, at the step 11, while if the answer is no, the former is subtracted from the latter at the step 12. Then, a mean value KREF is calculated from the $KO_2$ value thus obtained, at the step 13. Calculation of the mean value KREF can be made by the use of the following equation:

$$KREF = \frac{CREF}{A} \times KO_2p + \frac{A - CREF}{A} \times KREF \qquad (1)$$

where $KO_2p$ represents a value of $KO_2$ obtained immediately before or immediately after a proportional term (P-term) control action, A a constant (e.g. 256), CREF a variable which is experimentally determined and set to a value within a range from 1 to A−1, and KREF' a mean value of values $KO_2$ obtained from the start of the first operation of an associated control circuit to the last proportional term control action inclusive.

The value KREF' is stored in a storage means in the ECU without being erased even when the engine is at rest.

Since the value of the variable CREF determines the ratio of the value $KO_2p$ obtained at each P-term control action, to the value KREF, an optimum value KREF can be obtained by setting the value CREF to a suitable value within the range from 1 to A−1 depending upon the specifications of an air/fuel ratio control system, an engine, etc. to which the invention is applied.

As noted above, the value KREF is calculated on the basis of a value $KO_2p$ obtained immediately before or immediately after each P-term control action. This is because an air/fuel ratio of the mixture being supplied to the engine occurring immediately before or immediately after a P-term control action that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREF most appropriate to the actual operating condition of the engine.

The mean value KREF can also be calculated from the following equation, in place of the aforementioned equation (1):

$$KREF = \frac{1}{B} \sum_{j=1}^{B} KO_2pj \quad (2)$$

where $KO_2pj$ represents a value of $KO_2p$ obtained immediately before or immediately after a jth P-term control action before the present one, and B a constant which is equal to a predetermined number of P-term control actions (a predetermined number of inversions of the $O_2$ sensor output) subjected to calculation of the mean value. Since the larger the value of B, the larger the ratio of each value $KO_2p$ to the value KREF, the value of B is set at a suitable value depending upon the specifications of an air/fuel ratio feedback control system, an engine, etc. to which the invention is applied. According to the equation (2), calculation is made of the sum of the values of $KO_2pj$ from the P-term control action taking place B times before the present P-term control action to the present P-term control action, each time a value of $KO_2pj$ is obtained, and the mean value of these values of $KO_2pj$ forming the sum is calculated.

Further, according to the above equations (1) and (2), the mean value KREF is renewed each time a new value of $KO_2p$ is obtained during each feedback control operation based upon the $O_2$ sensor output, by applying the above new value of $KO_2p$ to the equations. Thus, the value of KREF obtained always fully represents the actual operating condition of the engine in the feedback control region.

The mean value of KREF calculated as described above is stored in a storage means for use in control of the air/fuel ratio of the mixture together with the other correction coefficients, that is, a wide-open-throttle correction coefficient KWOT and a mixture-leaning operation correction coefficient KLS, etc, during an open loop control operation immediately following the feedback control operation based upon the $O_2$ sensor output in which the same value KREF has been calculated.

The coefficients $KO_2$, KREF, KTW, KWOT, KLS, etc. are used for correction of the fuel quantity or the air/fuel ratio of an air/fuel mixture being supplied to the engine, in the following manner, for instance. The following is an equation for calculating the fuel injection period TOUT for fuel injection valves of the engine:

$$TOUT = TI \times K1 + K2$$

where Ti represents a basic fuel injection period which is calculated as a function of engine rpm and intake pipe absolute pressure, and K1 and K2 represent correction coefficients havin values determined by coefficients including the above coefficients $KO_2$, KREF, etc. having values dependent upon engine parameters such as throttle valve opening, intake pipe absolute pressure, intake air temperature, engine cooling water temperature, and engine rpm. The correction coefficients K1, K2 are applied for the purpose of achieving optimum operating characteristics of the engine such as startability, emission characteristics, and driveability. The engine is therefore supplied with a quantity of fuel corresponding to a value of the above fuel injection period TOUT calculated by means of the above equation, through the fuel injection valves.

Reverting now to FIG. 1, if the answer to the question of the step 7 is no, that is, if the $O_2$ sensor output level remains at the same level, or if the answer to the question of the step 8 is yes, that is, if the previous loop was an open loop, the air/fuel ratio of the mixture is controlled by integral term control (I-term control). More specifically, whether or not the $O_2$ sensor output level is low is determined at the step 14. If the answer is yes, TDC signal pulses, which are each generated at a predetermined crank angle of the engine and used as timing pulses, are counted at the step 15, accompanied by determining whether or not the count nIL has reached a predetermined value nI (e.g. 30 pulses), at the step 16. If the predetermined value nI has not yet been reached, the $KO_2$ value is held at its immediately preceding value, at the step 17. If the value nIL is found to have reached the value nI, a predetermined value Δk (e.g. about 0.3% of the $KO_2$ value) is added to the $KO_2$ value, at the step 18. At the same time, the number of pulses nIL so far counted is reset to zero at the step 19. After this, the predetermined value Δk is added to the $KO_2$ value each time the value nIL reaches the value nI. On the other hand, if the answer to the question of the step 14 is found to be no, TDC signal pulses are counted at the step 20, accompanied by determining whether or not the count nIH has reached the predetermined value nI at the step 21. If the answer is no at the step 21, the $KO_2$ value is held at its immediately preceding value, at the step 22, while if the answer is yes, the predetermined value Δk is subtracted from the $KO_2$ value, at the step 23, and simultaneously the number of pulses nIH so far counted is reset to zero at the step 24. Then, the predetermined value Δk is subtracted from the $KO_2$ value each time the value nIH reaches the value nI in the same manner as mentioned above.

Each time each of the above-mentioned steps 17, 19, 22 and 24 is executed, the program proceeds to the step 15, where a determination is made as to the occurrence of an abnormality in the $O_2$ sensor. FIG. 3 shows details of the step 25 in FIG. 1, which is a second manner of determination of the $O_2$ sensor abnormality. First, it is determined whether or not the engine rpm Ne is higher than predetermined rpm (e.g. 30 rpm), at the step **25*a*. If the answer to the question of the step 25*a* is no, that is, if the engine rpm Ne is smaller than the predetermined rpm or 30 rpm, the execution of the program is terminated without determining the abnormality of the $O_2$ sensor. Next, if the answer to the question at the step 25*a* is yes, a difference $\Delta KO_2$ ($=KO_2n-KO_2n-1$) between a value $KO_2n$ of the value $KO_2$ determined at the present loop and one $KO_2n-1$ determined at the preceding loop is determined, at the step 25*b*. It is then determined at the step 25*c* whether or not the determined difference $\Delta KO_2$ has continuously assumed a negative value or a positive value for a predetermined period of time, e.g. one minute. If the answer to this question is affirmative, it is judged that there is an abnormality in the functioning of the $O_2$ sensor, and a warning action is taken at the step 25*d*, and at the same time, the value $KO_2$ is set to the mean value KREF, at the step 25*e***.

Figure 4A:
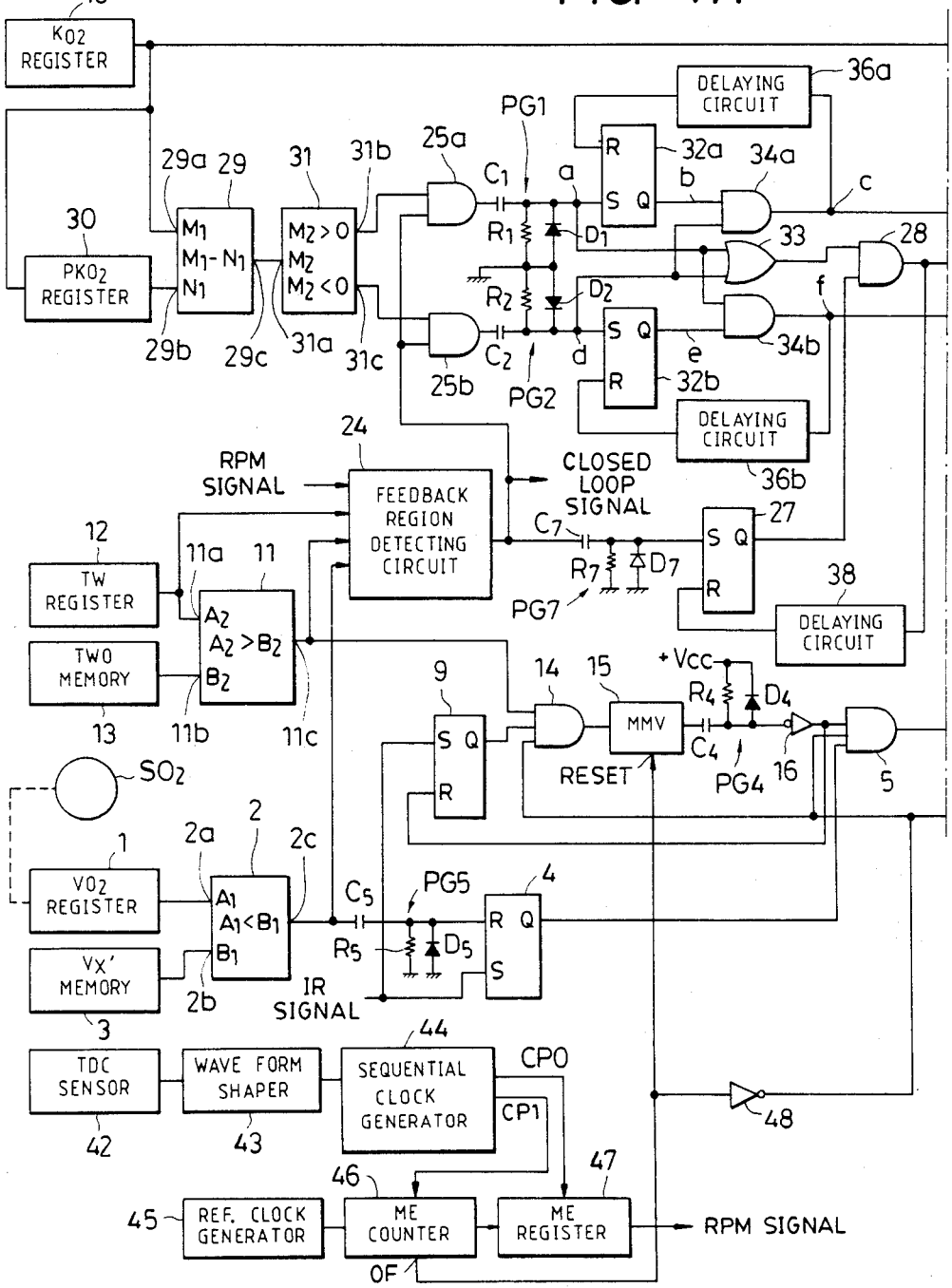

FIG. 4 shows an example of a circuit diagram for determining an abnormality in the functioning of the $O_2$ sensor and switching the value of the coefficient $KO_2$ over to the mean value KREF upon determination of such abnormality.

In FIG. 4, a $VO_2$ value register 1 stores a digital value corresponding to an output signal from the $O_2$ sensor $SO_2$, and this stored value $VO_2$ is supplied to a comparator 2 through its one input terminal 2*a* as an input A1, which in turn has its other input terminal 2*b* supplied with a value Vx' corresponding to the aforementioned predetermined reference voltage Vx from a memory 3, as an input B1. The comparator 2 compares these two input values A1, B1, to determine whether or not the value $VO_2$ corresponding to the $O_2$ sensor output is smaller than the value Vx' corresponding to the reference voltage Vx, shown at the step 1 in FIG. 1. If the input relationship of $VO_2 < Vx'$ stands (A1<B1), the comparator 2 generates a high level output of 1 and supplies it to a pulse generator PG5 which is composed of a capacitotr C5, a registor R5 and a diode D5 to cause same to generate a high level single pulse. This high level single pulse from the pulse generator PG5 is applied to a flip flop 4 through its reset pulse input terminal R. When reset, the flip flop 4 has an output from its Q-output terminal changed from a high level of 1 to a low level of 0, and this low level output of 0 is applied to an AND circuit 5 at its one input terminal. Incidentally, at the start of the engine, the flip flop 4 has its set pulse input terminal S supplied with an IR signal, referred to later, so that the output through its Q-output terminal has a high level of 1.

FIG. 5 shows a circuit for generating the above-mentioned IR signal upon closing of the ignition switch 6 of the engine. When the ignition switch 6 is closed, an output voltage from a battery, not shown, is supplied to a constant voltage-regulator circuit 7 which in turn supplies a constant voltage current +Vcc. Connected to the output of the constant voltage-regulator circuit 7 is a pulse generator PG6 which is formed by a resistor R6 and a capacitor C6 serially connected between the output of the circuit 7 and the ground, and a diode D6 connected between the output of the circuit 7 and the junction J1 of the resistor R6 with the capacitor C6 and in parallel therewith. When the constant voltage-regulator circuit 7 starts to supply constant voltage current +Vcc, the pulse generator PG6 generates a low level pulse at the junction J1. This low level pulse is inverted into a high level pulse or IR signal, by an inverter 8. This single pulse IR signal is generated only when the ignition switch 6 is closed as noted above, and supplied to the aforementioned flip flop 4 and further flip flops 9 and 10, hereinafter referred to, at their set pulse input terminals S to cause the outputs through their Q-output terminals to become a high level of 1.

Reverting now to FIG. 4, a comparator 11 has an input terminal 11*a* connected to a TW value register 12 which stores an output value from an engine cooling water temperature sensor, not shown, and supplied with an engine temperature value therefrom as an input A2. The comparator 11 has its other input terminal 11*b* connected to a TW0 value memory 13 and supplied therefrom with a digital value indicative of the predetermined value TW0 as an input B2. The comparator 11 compares these input values A2, B2 as at the step 2*a* in FIG. 2, and when it determines that the input relationship of A2>B2 stands, that is, when the engine water temperature TW is higher than the predetermined value TW0, it generates a high level output of 1 through its output terminal 11*c* and applies same to an AND circuit 14 at its one input terminal.

The AND circuit 14 has its other input terminals connected to the Q-output terminal of the aforementioned flip flop 9 as well as the output of an inverter 48, referred to later. The AND circuit 14 is energized by high level outputs applied thereto from both of the flip flop 9 set by the aforementioned IR signal and the inverter 48. The energized AND circuit 14 allows a high level output from the comparator 11 to pass therethrough and be applied to a monostable multivibrator 15 to cause it to generate a high level output which lasts for a predetermined period of time, e.g. 10 minutes (step 2*c* in FIG. 2). Upon the lapse of the predetermined period of time, the output from the monostable multivibrator 15 changes from a high level to a low level, and this low level output is applied to a pulse generator PG4 which is connected to the output of the monostable multivibrator 15 and formed by a capacitor C4, a resistor R4 and a diode 4. Upon being supplied with the above low level output from the multivibrator 15, the pulse generator generates a single low level pulse, which is inverted into a high level by an inverter 16 and applied to the aforementioned AND circuit 5 through its one input terminal, as well as to the reset pulse input terminal R of the aforementioned flip flop 9. Upon being supplied with the above high level signal at its reset pulse input terminal R, the Q-output from the flip flop 9 is changed from a high level of 1 to a low level of 0 to deenergize the AND circuit 14.

The AND circuit 5 has its input also connected to the output of the aforementioned inverter 48. On this occasion, when a high level output from the inverter 48 indicative of engine rpm Ne larger than the predetermined rpm or 30 rpm is applied to the AND circuit 5, it generates a high level output of 1 and applies same to an OR circuit 17. That is, the output from the AND circuit 5 becomes high if the output voltage from the $O_2$ sensor is higher than the reference voltage Vx and simultaneously the engine rpm Ne is larger than the predetermined rpm or 30 rpm after the lapse of the aforementioned predetermined period of time (e.g. 10 minutes) from a time the engine water temperature TW has exceeded the predetermined value TW0. The high level output from the AND circuit 5 is applied to on OR circuit 17.

When supplied with a high level signal at either of its two input terminals, the OR circuit 17 generates a high level output of 1 and applies same to the aforementioned flip flop 10 at its reset pulse input terminal R so that the $\overline{Q}$-output of the same flip flop goes low while the Q-output goes high. The Q-output terminal of the flip flop 10 is connected to one input terminal of an AND circuit 19 which has its other input terminals connected to the outputs of a $KO_2$ value register 18 and a feedback mode control region determining circuit 24. The flip flop 10 has its $\overline{Q}$-output terminal connected through an OR circuit 20 to one input terminal of an AND circuit 21 which has its other input terminal connected to a KREF value register 22. The $KO_2$ value register 18 and the KREF value register 22 store the values $KO_2$ and KREF previously explained with reference to FIG. 1. The Q-output from the flip flop 10 is applied to the AND circuit 19 to deenergize same, while the $\overline{Q}$-output from the same flip flop is applied to the AND circuit 21 through the OR circuit 20 to energize the circuit 21 whereby the mean value KREF of values of $KO_2$ is fed through the AND circuit 21 and an OR circuit 23 to a valve opening period calculating circuit, now shown, for calculation of the value opening period TOUT for fuel injection valves, not shown.

Once the flip flop 10 has been reset due to the occurrence of an abnormality in the $O_2$ sensor or its related wiring system, it serves to block the supply of the $KO_2$ value from the $KO_2$ value register 18 to the above valve opening period calculating circuit while allowing the supply of the mean value KREF from the KREF value register 22 to the same calculating circuit, until the engine is stopped.

The aforementioned feedback mode control region determining circuit 24 determines whether or not the engine is in a feedback mode control region, on the basis of various parameter signals including an engine water temperature signal from the TW value register 12, a signal indicative of an engine temperature TW exceeding the predetermined temperature TW0 from the comparator 11, a signal indicative of whether or not the output voltage from the $O_2$ sensor is higher or lower than the reference voltage Vx, an intake pipe absolute pressure signal, a throttle valve opening signal and an engine rpm signal from an Me value register 47, referred to later, and when the engine is determined to be in such feedback mode control region, it generates a closed loop signal having a high level of 1. The closed loop signal from the feedback mode control region determining circuit 24 is applied to AND circuits 25*a*, 25*b* and 26 to energize these circuits, while at the same time, it is applied to the aforementioned AND circuit 19. The same closed loop signal is also applied to a pulse generator PG7 formed by a capacitor C7, a resistor R7 and a diode D7 to cause same to generate a high level single pulse responsive to the input closed loop signal. This single pulse is applied to a flip flop 27 at its set pulse input terminal to cause the same flip flop to generate a high level output of 1 through its Q-output terminal. This high level Q-output is applied to an AND circuit 28 to energize same.

A subtracter 29 has one input terminal 29*a* supplied with a value $KO_2n$ determined in the present loop from the $KO_2$ value register 18 as an input M1, while its other input terminal 29*b* is supplied with a value $KO_2n-1$ from a $PKO_2$ value register 30 determined in the preceding loop, as an input N1. In the subtracter 29, a subtraction is made of the input value N1 from the input value M1, as at the step 25*b* in FIG. 3, and the resulting difference $\Delta KO_2$ (=M1−N1) is applied to a comparator 31 through its one input terminal 31*a*, as an input M2. The $PKO_2$ value register 30, which stores a $KO_2$ value determined in the preceding loop, has its input connected to the output of the $KO_2$ value register 18 to be supplied with a $KO_2$ value of the preceding loop therefrom.

Figure 6:
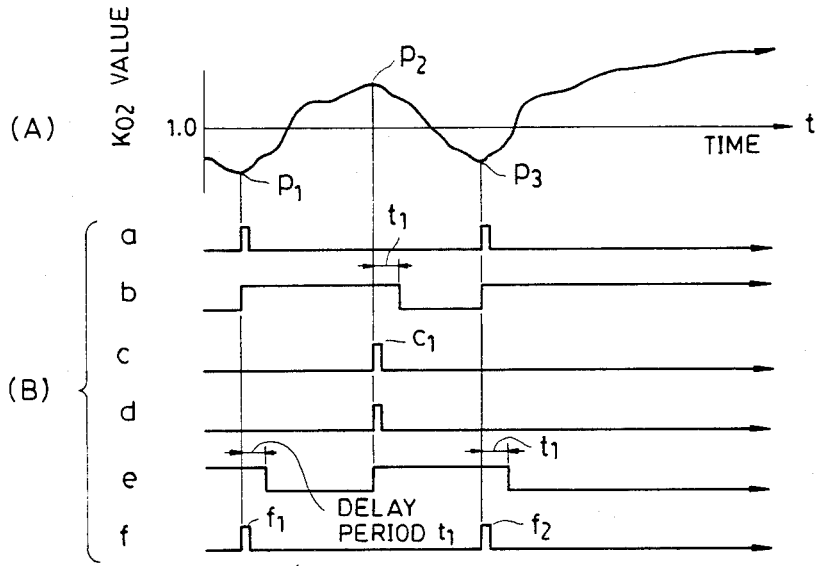
FIG. 6 is a timing chart showing changes in the signal levels at the points a to f in the circuit of FIG. 4 with respect to time.

The comparator 31 determines whether or not the input value M2 is larger than zero, as at the step 25*c* in FIG. 3, and when the value $\Delta KO_2$ assumes a positive value, it generates a high level output of 1 through its one output terminal 31*b*, and applies same to one input terminal of the AND circuit 25*a*, while when the value $\Delta KO_2$ assumes a negative value, it generates a high level output of 1 through its other output terminal 31*c* and applies same to one input terminal of the AND circuit 25*b*. Connected to the output of the AND circuit 25*a* is a pulse generator PG1 which is formed by a capacitor C1, a resistor R1, and a diode D1, and which has an output junction a connected to the set pulse input terminal S of a flip flop 32*a*, as well as one input terminal of each of an OR circuit 33 and an AND circuit 34*b*. On the other hand, the AND circuit 25*b* has its output connected to a pulse generator PG2 formed by a capacitor C2, a resistor R2 and a diode D2, having an output junction d connected to the set pulse input terminal S of a flip flop 32*b*, as well as the other input terminal of the above OR circuit 33 and one input terminal of an AND circuit 34*a*. The flip flops 32*a*, 32*b* have their Q-output terminals connected to the other input terminals of the respective AND circuits 34*a*, 34*b*, respectively, through junctions b and e. The AND circuits 34*a* and 34*b* have their respective output junctions c and f both connected to an OR circuit 35, and also connected to the reset pulse input terminals R of the flip flops 32*a* and 32*b* through respective delaying circuits 36*a* and 36*b*. FIG. 6 shows changes in the signal levels at the junctions a through f in FIG. 6, responsive to the change of the $KO_2$ value signal from the $KO_2$ value register 18. When the comparator 31 determines that the value or sign of $\Delta KO_2$ (input value M2) has changed from negative to positive (the point P1 in (A) of FIG. 6), it generates a high level output of 1 through its ouput terminal 31*b* and applies same to the pulse generator PG1 through the AND circuit 25*a* which is then energized as noted above, so that the pulse generator PG1 generates a high level single pulse as seen at a of (B) of FIG. 6. This high level single pulse is applied to a monostable multivibrator 37 through an OR circuit 33, the AND circuit 28 then energized, and an OR circuit 35, so that the monostable multivibrator 37 generates a high level output of 1. This monostable multivibrator 37 is a retriggerable type, that is, while upon being supplied with a trigger pulse, it generates a high level output having a predetermined duration (e.g. one minute), it is reset by a further trigger pulse which is inputted thereto before the lapse of the above predetermined duration, to start generating another high level output having the same predetermined duration.

The high level single pulse at the junction a in FIG. 6 is also supplied through the OR circuit 33 and the AND circuit 28 to the delaying circuit 38 to trigger same to apply a reset pulse to the flip flop 27 after the lapse of a predetermined period of time. When reset, the flip flop 27 generates a low output through its Q-output terminal, and applies same to the AND circuit 28 to deenergize same. In this manner, when there occurs an inversion in the level of the $\Delta KO_2$ value for the first time after it has been determined by the feedback mode control region determining circuit 24 that the engine is in the feedback mode control region, the AND circuit 28 allows a high level single pulse generated at the junction a or at the junction d, referred to later, to be applied to the monostable multivibrator 37 through the OR circuit 35 only once.

The high level single pulse generated at the junction a is also supplied to the flip flop 32*a* to cause its Q-output to go high (b of (B) of FIG. 6), which is applied to the AND circuit 34*b* to cause same to generate a high level single pulse f1 (f of (B) of FIG. 6). This high level single pulse is applied, on hand, to the monostable multivibrator 37 through the OR circuit 35 to reset same, and on the other hand, to the delaying circuit 36*b* to trigger same to generate a reset pulse which is applied to the flip flop 32*b* to reset same after the lapse of a predetermined period of time t1. When thus reset, the flip flop 32*b* generates a low level Q-output (e of (B) of FIG. 6) and applies same to the AND circuit 34*b* to deenergize same.

When the value of $\Delta KO_2$ is inverted from positive to negative (the point p2 in (A) of FIG. 6), the comparator 31 now generates a high level output of 1 through its output terminal 31*c* and applies same to the pulse generator PG2 through the AND circuit 25*b* then energized, to cause same to generate a high level single pulse (d of (B) of FIG. 6). This high level single pulse is applied, on one hand, to the flip flop 32*b* to set same (e of (B) of FIG. 6), and, on the other hand, to the AND circuit 34*a* to cause same to generate a high level pulse C1 at the junction c on the output side of the same circuit 34*a* (c of (B) of FIG. 6). The high level pulse C1 is supplied through the OR circuit 35 to the monostable multivibrator 37 to reset same, and also through the delaying circuit 36*a* to the flip flop 32*a* to reset same.

Also when the value of $\Delta KO_2$ is changed from negative to positve,(the point p3 of (A) of FIG. 6), a high level pulse f2 generated at the junction f on the output side of the AND circuit 34*b* (f of (B) of FIG. 6) causes the monostable multivibrator 37 to be reset, in the same manner as described above.

So long as there occurs no change in the level of the value of $KO_2$ from negative to positive or vice versa, the monostable multivibrator 37 is not reset. If a predetermined period of time (e.g. one minute) elapses without the multivibrator being reset, its output turns a low level of 0. This means that there is an abnormality in the functioning of the $O_2$ sensor, as determined at the step 25*c* in FIG. 3. The above low level output from the monostable multivibrator 37 is applied to a pulse generator PG3 formed by a capacitor C3, a resistor R3 and a diode D3, to cause same to generate a low level pulse which is then inverted into a high level pulse by an inverter 39 and applied to one input terminal of the aforementioned AND circuit 26. When the AND circuit 26 is in an energized state, with its other input terminals supplied with the aforementioned closed loop signal as well as a high level signal from the inverter 48, indicative of engine rpm Ne higher than the aforementioned predetermined rpm, the above high level pulse from the inverter 39 passes through this energized AND circuit 26 and also through the OR circuit 17 and is applied to the flip flop 10 to reset same so that the outputting of the $KO_2$ value from the $KO_2$ value register 18 is blocked in the same manner as described above, while at the same time allowing outputting of the mean value KREF from the KREF value register 22.

When the closed loop signal having a high level is not outputted from the feedback mode control region determining circuit 24, that is, when the engine is in a particular operating condition other than the feedback mode control region, the AND circuits 25*a*, 25*b* and 26 are all in a deenergized state, to prohibit execution of the determination as to whether the value of $\Delta KO_2$ has not changed from negative to positive or vice versa for the aforementioned predetermined period of time, and at the same time, the AND circuit 19 is also in a deenergized state, prohibiting outputting of the $KO_2$ value from the $KO_2$ value register 18 through the same AND circuit 19. On the other hand, the closed loop signal from the feedback mode control region determining circuit 24, which has been changed into a low level, causes a NAND circuit 40 to generate a high level output, which is then applied to the monostable multivibrator 37 through its reset pulse input terminal R to reset same, while at the same time, the same low level closed loop signal is inverted into a high level by an inverter 41, which causes the AND circuit 21 to be energized through the OR circuit 21, allowing outputting of the KREF value from the KREF value register 22 through the energized AND circuit 21.

A TDC sensor 42 generates a pulse as a TDC signal indicative of a predetermined crank angle of the engine each time the engine goes through the same predetermined crank angle, and the same pulse is supplied to a sequential clock generator 44 through a waveform shaper 43. The sequential clock generator 44 is responsive to each such pulse to successively generate two pulses CP0 and CO1. A reference clock generator 45 generates clock pulses and applies them to an Me value counter 46, which in turn counts the number of input clock pulses and supplies the resulting count to the Me value register 47. The Me value register 47 is loaded with such count upon being supplied with each pulse CP0. The loaded value in the Me value register 47 is supplied as an engine rpm signal to the feedback mode control region determining circuit 24. The Me value counter 46 is reset by a pulse CP1 immediately following the above pulse CP0 to start counting the number of clock pulses subsequently supplied from the reference clock generator 45. When the engine rpm drops below predetermined rpm (e.g. 30 rpm), the count counted by the Me value counter 46 reaches a predetermined count before the Me counter 46 is supplied with the next pulse CP1, so that the counter 46 generates a high level signal through an output terminal OF. This high level signal is supplied to a monostalbe multivibrator 15 through its reset pulse input terminal to reset same, and at the same time, it is inverted into a low level by the inverter 48 and then supplied to the aforementioned AND circuits 5, 14 and 26 to deenergize these circuits. The same low level signal through the inverter 48 is applied to the other input terminal of the aforementioned NAND circuit 40 which in turn generates a high level output to reset the monostable multivibrator 37. In this manner, when the engine rpm Ne is below the predetermined rpm or 30 rpm, the monostable multivibrators 15 and 37 are both maintained in a reset state, which can avoid the following disadvantages, for instance: (1) In the event that the engine is stopped without turning the ignition switch off immediately after the engine water temperature TW has increased above the predetermined value TW0, the aforementioned predetermined period of time (e.g. 10 minutes) elapses while the output voltage from the $O_2$ sensor does not drop below the predetermined voltage Vx even once, causing the monostable multivibrator 15 to generate a high level output of 1, providing a wrong diagnosis that there occurs an abnormality in the $O_2$ sensor; and (2) In the event that while the engine is the feedback mode control region where the throttle valve is in an open position, for instance, the engine is stopped without turning the ignition switch off so that the output level of the $O_2$ sensor does not change at all for the aforementioned predetermined period of time (e.g. one minute), the monostable multivibrator 37 generates a high level output of 1, also providing a wrong diagnosis of an abnormality occuring in the $O_2$ sensor.

What is claimed is:

1. In a method for controlling the air/fuel ratio of an air/fuel mixture being supplied to an internal combustion engine having means for detecting oxygen concentration in exhaust gases emitted from the engine, to desired values, by correcting a basic fuel quantity dependent upon values of predetermined parameters indicative of operating conditions of the engine, by the use of at least one coefficient each time each pulse of a predetermined control signal is generated, wherein a determination is effected whether or not the engine is operating in a predetermined feedback control region wherein the air/fuel ratio is controlled in response to the output from said oxygen concentration detecting means, and when it is determined that the engine is operating in said predetermined feedback control region a first coefficient is applied as one of said at least one coefficient, said first coefficient having a value variable with a change in the output from said oxygen concentration detecting means, the improvement comprising the steps of:

(1) calculating a mean value of values of said first coefficient applied during operation of the engine in said predetermined feedback control region;

(2) determining whether the engine is operating in any of a plurality of predetermined particular operating regions other than said predetermined feedback control region;

(3) applying as one of said at least one coefficient a second coefficient being said mean value of said first coefficient in place of said first coefficient when it is determined that the engine is operating in any of said predetermined particular operating regions;

(4) detecting an abnormality in the functioning of said oxygen concentration detecting means; and (5) applying as one of said at least one coefficient said second coefficient in place of said first coefficient always when an abnormality is detected in the functioning of said oxygen concentration detecting means, irrespective of whether the engine is then operating is said predetermined feedback mode control region or in any of said predetermined particular operating regions.

2. A method as claimed in claim 1, wherein said step (3) comprises determining a difference between a value of said first coefficient obtained at generation of a present pulse of said predetermined control signal and a value of said first coefficient obtained at generation of a preceding pulse of said predetermined control signal, and determining that there is an abnormality in the functioning of said oxygen concentration detecting means, when said difference does not change between a negative value and a positive value for a predetermined period of time.

3. A method as claimed in claim 1, wherein said step (3) comprises: (a) comparing an output voltage value from said oxygen concentration detecting means with a predetermined reference voltage value; (b) comparing the temperature of the engine with a predetermined temperature; (c) determining that there is an abnormality in the functioning of said oxygen concentration detecting means, when as results of said steps (a) and (b) it is determined that the output voltage value from said oxygen concentration detecting means does not change across said predetermined reference voltage value at all for a second predetermined period of time after the start of the engine, while the temperature of the engine is higher than said predetermined temperature from the start of the engine.

4. A method as claimed in claim 1, wherein said step (3) comprises: (a) comparing an output voltage value from said oxygen concentration detecting means with a predetermined reference voltage value; (b) comparing the temperature of the engine with a predetermined temperature; (c) determining that there is an abnormality in the functionining of said oxygen concentration detecting means, when as results of said steps (a) and (b) it is determined that the output voltage value from said oxygen concentration detecting means does not change across said predetermined reference voltage value at all for a second predetermined period of time after the temperature of the engine has increased above said predetermined temperature after the start of the engine.

5. A method as claimed in any of claims 1, 2, 3 or 4, wherein the detection of an abnormality in the functioning of said oxygen concentration detecting means at said step (3) is prohibited while the rotational speed of the engine is lower than a predetermined speed.

* * * * *